United States Patent [19]

Farmer

[11] 4,165,198

[45] Aug. 21, 1979

[54] METHOD FOR FORMING PIER FOUNDATION COLUMNS

[75] Inventor: Glyen D. Farmer, Houston, Tex.

[73] Assignee: Farmer Foundation Company, Houston, Tex.

[21] Appl. No.: 845,857

[22] Filed: Oct. 27, 1977

Related U.S. Application Data

[63] Continuation-in-part of Ser. No. 720,694, Sep. 7, 1976, abandoned.

[51] Int. Cl.[2] ..... E02D 5/40

[52] U.S. Cl. ..... 405/243; 405/222; 405/257

[58] Field of Search ..... 61/53.64, 53.66, 56.5, 61/53.5; 405/243, 236, 240, 222, 257

[56] References Cited

U.S. PATENT DOCUMENTS

| | | | |
|---|---|---|---|
| 3,316,723 | 5/1967 | Schutte | 61/53.64 |
| 3,385,070 | 5/1968 | Jackson | 61/56.5 X |
| 3,543,525 | 12/1970 | Phares | 61/53.66 |
| 3,973,408 | 8/1976 | Paverman | 61/53.64 X |

FOREIGN PATENT DOCUMENTS

| | | | |
|---|---|---|---|
| 732494 | 6/1955 | United Kingdom | 61/53.66 |

*Primary Examiner*—Jacob Shapiro
*Attorney, Agent, or Firm*—Bard & Groves

[57] ABSTRACT

This invention comprises a technique for constructing concrete foundation columns in underwater locations, wherein the steel casing members used to form the columns may be recovered for subsequent re-use. In the technique, an inner and outer casing are partially imbedded in the ground submerged in the water and in concentric relationship with one another. The annulus formed between said inner and outer casing is filled with unconsolidated sand, while the inner casing is filled with reinforcing material and concrete to form the column. The inner casing is then vibrated at a suitable frequency to reduce the friction between it and the sand and concrete, whereby the inner casing may then be drawn upwardly and from between said concrete and the sand. The sand will then support the concrete until after said concrete has hardened, whereupon the outer casing may then be removed, either by vibration or by conventional techniques.

12 Claims, 7 Drawing Figures

METHOD FOR FORMING PIER FOUNDATION COLUMNS

RELATED CASES

This application is a continuation-in-part of U.S. Patent Application Ser. No. 720,694, filed Sept. 7, 1976, and now abandoned.

BACKGROUND OF THE INVENTION

This invention relates to the construction of foundation columns and more particularly to the construction of foundation columns in submerged locations as for the support of wharfs, bridges and the like.

Foundation columns have long been used as support members for structures which are built upon such columns. The support provided by the foundation column is derived from the frictional forces developed between the foundation column and the ground within which the foundation column is imbedded. In a water environment, one end of the column extends into the earth but the other end must extend through the water to a height at or above the surface of the water.

The basic construction technique for a foundation column is to drill a hole and fill the hole with concrete. Where the ground does not provide adequate lateral support for the concrete during the hardening of the concrete or where the column is to extend above the ground, an outer casing must be provided to contain the concrete until the concrete has hardened. Easily removable casings, such as split-shell type casing, have long been used where access to the column could be obtained. In underwater locations, however, a casing has to be slipped from around the column in order to be removed. This could not be done without damage to the column once the concrete had hardened so these outer casing generally remained in place around the completed columns.

The cost of steel casing, however, has now become a major portion of the total cost for constructing a foundation column. Although all costs have increased, the cost of steel has risen disproportionately to the extent that the cost of the steel casings would be about one-fourth of the total job costs if the casings are left around the completed column. It is apparent that a significant competitive cost advantage can be achieved if the steel casing can be removed and re-used to construct additional foundation columns. As hereinabove explained, this re-useability feature is easily obtained at on-shore locations or at portions of a foundation column which extend into the air by simply providing hinged casing sections which can be opened after the concrete has hardened.

During construction of some on-shore piers, a casing having a generally wedge shaped plug at one end is driven into the ground to form a hole for the pier. As shown in U.S. Pat. No. 3,842,609, to Gilberd and Russian Certificate 285,621 to Brande et al, the casing is then filled with concrete and the casing is withdrawn from around the uncured concrete. A vibratory hammer is applied to the casing during removal to break the bond between the casing and the concrete. The earth which has been compacted about the casing as the casing was driven into the ground then acts to support and mold the concrete.

A more difficult problem is presented in attempting to remove the steel casing in an underwater environment. Here, the basic approach utilizes a "two-casing" technique. This basic approach is illustrated by Great Britain Patent Specification No. 732,494, which teaches an outer casing and an inner or moulding casing concentrically installed within the outer casing. The annulus between the two casings is filled with a filler material, such as sand, and the inner casing then filled with concrete. The inner casing is removed before the concrete has hardened whereupon the sand supports the concrete until the concrete has hardened. The sand is compacted by the hydrostatic head of the uncured concrete as the inner casing is withdrawn and the concrete slumps against the sand. Finally, the outside casing is removed and the filler material simply falls to the ground. The technique disclosed by said patent, however, is limited to relatively shallow depths of water wherein the surface area between the inner casing and the sand filler material does not become so large that the resulting static friction and viscous drag forces cannot be overcome by upward forces applied to the inner casing.

U.S. Pat. No. 3,316,723, discloses another variation of the "two-casing" technique. As disclosed by said patent, the inner casing is first filled partially or entirely with concrete. A filler material is then added in the annulus to a depth which does not result in excessive friction and viscous drag forces between the inner casing and the filler material. The inner casing is next moved upwardly to a height just short of the filler material level. This alternating addition of filler material and incremental extraction of the inner casing continues until the desired height for the foundation column is obtained. The inner casing is then pulled clear of the concrete column member.

One problem with this technique is the time required to alternate pouring and pulling. Additionally, if the inner casing is pulled above the level of the filler material, structural irregularities in the foundation column can occur from the resulting intermingling of filler material and concrete.

The disadvantages of the prior art are overcome by the present invention, however, and improved method are provided for constructing pier foundation columns in underwater locations.

SUMMARY OF THE INVENTION

In a preferred embodiment of the present invention, concrete foundation columns are constructed in underwater locations and the steel casing members used to form the columns may be recovered for subsequent re-use. An outer casing is first installed at the location wherein a foundation column is desired and an inner casing is disposed concentrically therein. The annulus formed between the inner and outer casings is filled with a filler material, such as unconsolidated sand, and a reinforcing structure is placed within the inner casing and concrete is poured to a pre-determined level within the inner casing. The inner casing is then vibrated while an upward force is applied to slip the inner casing from between the concrete and the filler material. The removal of this inner casing must occur before the concrete has been in place long enough to bond to the casing. The filler material supports the concrete until the concrete has hardened, whereupon the outer casing is slipped upwardly from around the completed foundation column.

It is a feature of the present invention to provide a new and improved method for forming concrete foundation columns wherein an inner and outer casing are employed and wherein said casings are re-useable in constructing subsequent foundation columns.

Another feature of this invention is to provide a new and improved method for forming foundation columns using an inner and outer casing and where said inner casing can be continuously withdrawn from between the filler material and the concrete.

It is a particular feature of the present invention for the inner casing to be vibrated during removal from between the filler material and the concrete.

These and other features and advantages of the present invention will become apparent from the following detailed description, wherein references are made to the figures in the accompanying drawing.

BRIEF DESCRIPTION OF THE DRAWINGS

Figure 1:
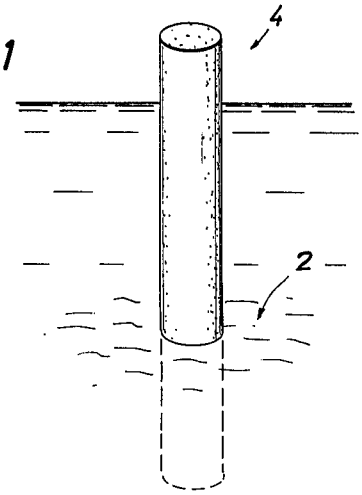
Figure 2:
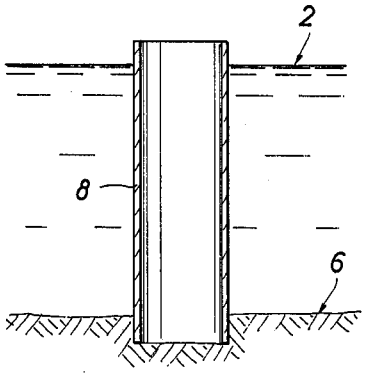
Figure 3:
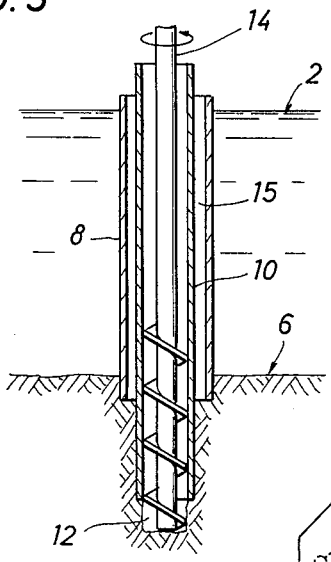
Figure 4:
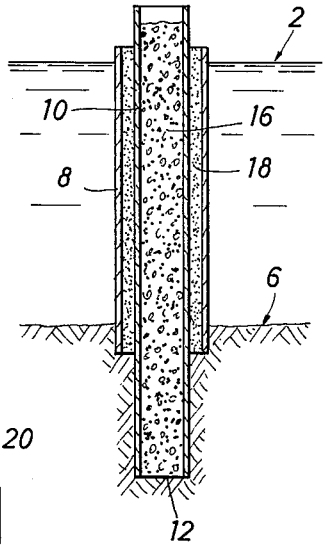
Figure 5:
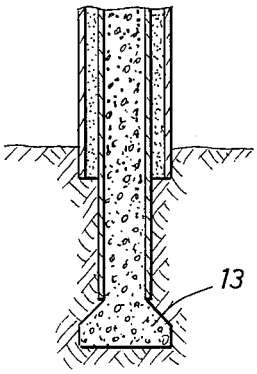
Figure 5:
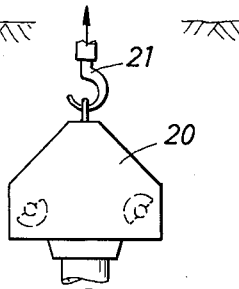
Figure 6:
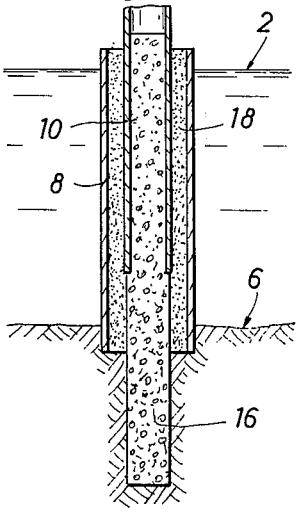
Figure 7:
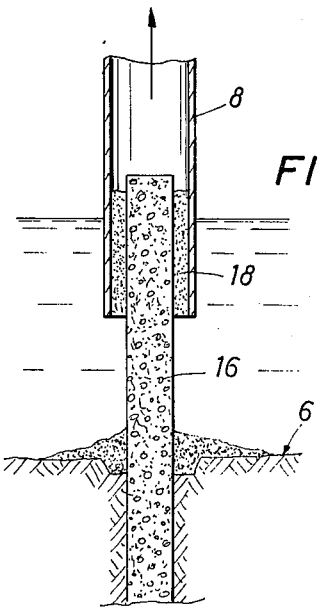

IN THE DRAWINGS:

FIG. 1 is a simplified pictorial of a foundation pier formed by the process of the present invention;

FIG. 2 is a pictorial view of the outer casing as installed;

FIG. 3 is a pictorial view of the installed inner casing and auger therein;

FIG. 4 is a pictorial view of the filled casing;

FIG. 5 is a pictorial view of a bell footing on the column;

FIG. 6 is an elevation view, partly in section, of a vibrator connected to the inner casing;

FIG. 7 is a pictorial view of the outer casing partially removed.

DETAILED DESCRIPTION OF THE DRAWINGS

Referring now to the drawings and more particularly to FIG. 1, there may be seen a view of a completed concrete foundation column 4 constructed in accordance with the method of the present invention and extending from beneath a body of water 2 such as a river, lake, bay or the like. Foundation columns 4 may be one of many such foundation columns constructed to support a wharf, bridge, building or other desired structure.

Referring now to FIG. 2, an outer casing 8 is shown. One end of outer casing 8 may be partially imbedded in the ground 6 under the water 2 so that the outer casing 8 is firmly supported to prevent lateral movement during subsequent construction steps and to seal the bottom of casing 8 against water entry or concrete escape. The other end of outer casing 8 usually extends above the surface of the water 2 to a convenient working height.

Referring now to FIG. 3, there may be seen an inner casing 10 installed in concentric relationship with outer casing 8 so that an annulus 15 is formed therebetween. Annulus 15 is thus formed over the entire above ground length of outer casing 8. In the preferred method, annulus 15 is generally symmetrical around inner casing 10.

Referring again to FIG. 3, there may be seen a drill or auger inserted interiorly of inner casing 10. A hole 12 is drilled in the ground 6 beneath the water 2 to a level predetermined in accordance with standard techniques to provide sufficient support for the foundation column and the structure to be erected thereon. If it is desired, inner casing 10 may be further imbedded in the ground 6 as the hole 12 is drilled. The need for casing the hole 12 in the ground 6 is generally predetermined by analysis of the soil conditions of ground 6 underlaying the water 2. In some instances hole 12 is formed prior to installing casing 10. Casing 10 is then set into the ground 6 a depth necessary to seal the interior of casing 10 and prevent the escape of concrete.

It should be noted that the inner and outer casings, as seen in FIGS. 2 and 3, may be imbedded in the ground 6 by a variety of techniques. Pile driving equipment may be used to pound the casings into position. If reusability is a factor, as herein discussed, holes may be drilled and the casings inserted into the holes. Alternatively, and particularly where soil conditions do not permit holes to be drilled without casings in place, a mechanical vibrator, as more fully discussed hereinbelow, may be used to imbed the casings in the ground. Still another consideration in placing casing 10 is the possibility of clay adhering to the bottom of the casing 10. Adherent clay would damage the uncured concrete as casing 10 is removed, as hereinbelow described, and can be prevented by applying a lubricant, such as grease, to the casing and then setting the casing 10 by screwing in place rather than driving in place.

Referring now to FIG. 4, outer casing 8 is illustrated after being filled with filler material 18 and inner casing 10 filled with concrete 16. Filler material 18 is generally comprised of unconsolidated sand, and is generally chosen to be a loosely granulated material which will not tend to adhere to inner casing 10. As illustrated, annulus 15 is completely filled with filler material 18. Most of the water in annulus 15 has been displaced, except for the water remaining in the interstitial volumes. Further, reinforcing material has been inserted and inner casing 10 has been filled with concrete 16 using standard techniques for introducing concrete through substantial lengths of casing. Concrete 16 fills the hole 12 previously drilled in the ground 6 and also fills inner casing 10 to a level above the surface of the water 2. It should be noted that the order of introducing filler material 18 into annulus 15 and concrete 16 into inner casing 10 may be interchanged within the scope of the present invention.

Referring now to FIG. 5, there may be seen an alternate embodiment of the present invention. As shown, the ground beneath inner casing 10 may be underreamed to form a generally truncated conical cavity 13. This conical shape 13 provides an enlarged bearing area at the bottom of the foundation column to improve the load carrying capabilities and stability of the completed column.

Referring now to FIG. 6, there may be seen a vibratory hammer 20 attached to inner casing 10. Lifting means 21 is further attached to vibratory hammer 20. Lifting means 21 may be suitable means for providing upward force on the joined vibratory hammer 20 and inner casing 10, such as a crane, derrick, or other hoist. Vibratory hammer 20 may be chosen from a number of commercially available mechanical vibratory hammers which operate in the frequency range needed to minimize the friction forces obtained between inner casing 10 and filler material 18 and concrete 16. For the most common filler material, sand, the minimum friction forces occur in a frequency range of 700–1200 vibrations per minute. When inner casing 10 is vibrated within this frequency range, the frictional forces between it and filler material 18 are thereby reduced so as to permit the upwardly acting force applied by lifting means 21 to remove inner casing 10 from around concrete column 16. This condition of reduced frictional forces occurs simultaneously over the entire length of casing 10, thereby enabling the casing 10 to be completely filled with concrete 16 before any upward movement is required. The vibrations also serve to further compact the concrete 16 and filler material 18 so that concrete 16 is fully supported by filler material 18 during the final process of hardening. It should be noted that inner casing 10 must be withdrawn before concrete 16 has hardened and a bond formed between the concrete 16 and inner casing 10.

It has been found that the vibratory hammer 20 can have a significant effect on the unconsolidated filler material in annulus 15. More particularly, the vibrations result in the movement of inner casing 10 when vibratory hammer 20 is activated. The magnitude of this movement is a function of many variables, including frequency of the vibrations, diameter of casing 10 and unsupported length of casing 10, all of which determine the proximity of applied frequency to the resonant lateral frequency of casing 10.

Further, the movement of casing 10 is imparted to a portion of the unconsolidated filler material 18 in annulus 15. If the movement is of sufficient magnitude, all of the unconsolidated filler material 18 can be set in motion so as to become fluidized. Once the filler material 18 is fluidized, it is incapable of supporting uncured concrete 10, whereby withdrawal of inner casing 10 will result in the concrete 10 displacing filler material 18. This result is of little significance at an on-shore location since the concrete is merely filling a hole. At the water location, the result is a complete loss of the outside casing 8 since outside casing 8 must then become the molding casing until concrete 10 has cured, whereupon casing 8 cannot be withdrawn.

Even in less extreme cases than hereinabove discussed, excess movement of the filler material can result in local concrete defects produced during removal of inner casing 10. An abnormally rough surface can result from surface fluidization of the filler material providing an ill-defined interface between the filler material and the concrete as inner casing 10 is withdrawn. Local areas of fluidization can result in a ring-like defect around the pier resulting from a lack of support from the filler material as the casing 10 is drawn past the local area.

In actual practice, it has been found that large diameter casings, e.g. diameters of about 5 feet or more, can be vibrated continuously within the frequency available for commercially available vibratory hammers without significant effects on the quality of the finished pier. However, when smaller diameter casings are employed, the procedure must be changed. For example, when inner casings having a diameter of about three feet were used, the vibratory hammer frequency was reduced to the minimum frequency available on the particular hammer (about 750 cps) and acceptable piers were produced. It was also found desirable to actuate the hammer only to break the bond between casing 10 and thereafter only as needed to maintain the withdrawal of casing 10 with a minimum application of vertical force.

The spacing between adjacent piers introduces yet another consideration when the piers are fabricated through water. Since water is substantially incompressible, vibratory energy supplied to casings at one location can be transmitted through the water to adjacent locations. This transmitted energy can produce abnormalities until the concrete has at least hardened. Thus, the construction schedule may conveniently be arranged to maintain the desired spacing between locations having unhardened concrete and locations where the vibratory hammer is being used.

Referring now to FIG. 7, outer casing 8 is shown during removal from around the concrete column 16 after the concrete has cured sufficiently to support itself. Outer casing 8 may also be vibrated during removal to minimize the force needed to slide outer casing 8 from around filler material 18. Filler material 18 merely drops to the ground 6 as outer casing 8 is removed. It will be noted that once outer casing 8 has been removed there is no remaining steel casing surrounding the completed concrete column. By vibrating inner casing 10 and outer casing 8 during removal, damage to the casing is minimized and the casing may be re-used in subsequent foundation forming operations.

Although the preferred embodiment is set forth hereinabove, the technique herein described for vibrating the inner or molding casing increases the flexibility in using a variety of two-casing techniques. If desired, the concrete 16 may be poured before filler material 18 is added in order for concrete 16 to set-up for some time before inner casing 10 is withdrawn. Further, the method can be accomplished by a series of incremental steps wherein annulus 15 is completely filled and concrete 16 is poured to a predetermined level. Inner casing 10 is vibrated while being withdrawn to a level just below the top of the concrete 16. Additional concrete 16 then poured to obtain another level and the sequence repeated until a complete column 4 is obtained. Alternately, inner casing 10 may be filled with concrete 10 and the filler material 18 added incrementally and alternately with inner casing 10 withdrawal.

Numerous variations and modifications may obviously be made in the techniques herein described without departing from the present invention. Accordingly, it should be clearly understood that the forms of the invention herein described and referred to in the figures in the accompanying drawing are illustrative only and are not intended to limit the scope of the invention.

What is claimed is:

1. A method of forming a concrete foundation column, comprising the steps of erecting an outer casing and the like at a preselected location, erecting an inner molding casing and the like at said location and substantially concentrically within said outer casing, depositing concrete in said inner casing, depositing an unconsolidated filler material within the annulus between said casings to a level sufficient to create viscous drag forces great enough to grippingly immobilize said inner casing within said outer casing, applying to said inner casing a lifting force greater than the weight of said inner casing and a vibratory force to cancel said viscous drag forces thereon to partially raise said inner casing within said outer casing, thereafter discontinuing said application of lifting and vibratory forces while repeating said step of depositing filler material in said annulus, and thereafter repeating said step of applying lifting and vibratory force to said inner casing.

2. The method described in claim 1, wherein said step of applying lifting and vibratory forces to said inner casing comprises simultaneously vibrating and slidably lifting said inner casing between said concrete and said filler material.

3. The method described in claim 1, wherein the step of applying said vibratory force comprises applying said vibratory force at a frequency range having a preselected functional relationship to the coefficient of friction between said inner casing and said filler material and the coefficient of friction between said filler material and said outer casing.

4. The method described in claim 3, wherein said frequency range is 700 to 1,200 vibrations per minute.

5. The method described in claim 1, further comprising the step of simultaneously vibrating and slidably lifting said outer casing.

6. A method of forming a concrete foundation column, comprising the steps of erecting an outer casing and the like at a preselected location, erecting an inner molding casing and the like at said location and substantially concentrically within said outer casing, depositing concrete in said inner casing, substantially filling the annulus between said casings with unconsolidated filler material, and applying to said inner casing a lifting force and a vibrating force to raise said inner casing within said outer casing.

7. The method described in claim 6, wherein the step of applying lifting and vibratory forces to said inner casing comprises simultaneously vibrating and slidably lifting said inner casing between said concrete and filler material.

8. The method described in claim 6, wherein said vibratory force is applied at a frequency range having a preselected functional relationship to the coefficient of friction between said inner casing and said filler and to the coefficient of friction between said filler material and said outer casing.

9. The method described in claim 8, wherein said frequency range is 700 to 1,200 vibrations per minute.

10. The method described in claim 6, further comprising the step of simultaneously vibrating and slidably lifting said outer casing.

11. The method described in claim 6, further comprising the steps of depositing said concrete in said inner casing to a partially filled level, applying to said inner casing a lifting force and a vibratory force to raise said inner casing within said outer casing to a level beneath said partially filled level, thereafter discontinuing said application of lifting and vibratory forces while repeating said step of depositing concrete in said inner casing, and thereafter repeating said step of applying lifting and vibratory forces to said inner casing.

12. The method described in claim 11, wherein the step of applying lifting and vibratory forces to said inner casing comprises simultaneously vibrating and slidably lifting said inner casing between said concrete and filler material.

* * * * *